US006030268A

United States Patent [19]

Lee

[11] Patent Number: 6,030,268

[45] Date of Patent: Feb. 29, 2000

[54] MATERIALS AND MANUFACTURING APPLICATION FOR CRT FRAME

[76] Inventor: Kun Hee Lee, #494, Hwang Sang Dong, Ku Mi, Kyung Book, Rep. of Korea, 730-330

[21] Appl. No.: 09/255,507

[22] Filed: Feb. 23, 1999

[51] Int. Cl.[7] ..... H01J 9/236

[52] U.S. Cl. ..... 445/30

[58] Field of Search ..... 445/30

[56] References Cited

U.S. PATENT DOCUMENTS 4,639,230 1/1987 Meyle et al. ..... 445/30

FOREIGN PATENT DOCUMENTS 19938 10/1997 Rep. of Korea .
20008 10/1997 Rep. of Korea .

*Primary Examiner*—Kenneth J. Ramsey

*Attorney, Agent, or Firm*—Schmeiser, Olsen & Watts; Robert J. Mauri

[57] ABSTRACT

Disclosed are a method for manufacturing a frame for a Braun tube and a base material used therefor. The base material has a rectangular plate-shaped configuration obtained by machining a metal plate-shaped strap. The base material possesses an extended guide opening defined at a center portion thereof, the extended guide opening having a shape which is similar to the configuration of the base material and a dimension which is smaller than the base material. The base material further possesses a plurality of extended rupture-preventing grooves each defined at a corner portion of the extended guide opening to be communicated therewith, the extended rupture-preventing grooves having a diameter which is smaller than that of the extended guide opening. The strap has a pair of deformation-preventing notches formed on both side edge surfaces thereof, respectively, at a boundary region between two adjacent base materials, each notch having a bottom portion which extends parallel to the edge surface of the strap.

2 Claims, 9 Drawing Sheets

MATERIALS AND MANUFACTURING APPLICATION FOR CRT FRAME

BACKGROUND OF THE INVENTION

1. Field of the Invention

The present invention relates to a base material of a frame for a Braun tube and a method for manufacturing the frame, and more particularly, the present invention relates to an improvement in a method for manufacturing a frame which supports a shadow mask used in a Braun tube or a picture tube such as a color Braun tube (CRT), a color tube (CPT), a color display tube (CDT) or the like.

2. Description of the Related Art

As shown in FIG. 7, in a color Braun tube, etc., a frame F is used for supporting a shadow mask which is a plate having a screen-shaped configuration and is extremely thin, such that it is intervened as a connecting holder plate between a panel P and a funnel F.

A plate having a rectangular configuration is used as a base material suitable for manufacturing a frame for a Braun tube. Generally, a frame for a Braun tube is manufactured by pressing the base material having a predetermined thickness through a series of machining processes including blanking, drawing and piercing, to a thin metal plate.

A window is defined in a center portion of the frame to be used as an opening through which beams injected from an electron gun can be passed. The window is defined by piercing the center portion of the frame to form the opening, and a segment cut out from the frame by the piercing process is discarded. Accordingly, due to the fact that the segment is discarded as scrap, material is wasted. Further, a base material to be formed as a frame must have a dimension which is larger than a predetermined one. This is because there exists a limit in a drawing rate when a solid plate material is subjected to a drawing process.

Hence, the frame manufactured according to the related art suffers from defects in that since a base material must have a dimension greater than a predetermined one and a segment cut out from a center portion thereof is discarded, material is wasted, and since remarkable power loss is caused in a press machine, manufacturing cost is increased.

In other words, referring to FIGS. 1 through 3, there are shown perspective views which illustrate a base material of a frame for a Braun tube and explain machining processes adopted for manufacturing the frame.

As shown in FIG. 1, a base material 1 used in manufacturing a frame for a Braun tube according to the related art has substantially a rounded rectangular configuration. In case of a 14 inch Braun tube, the base material has a dimension including a width of 276 mm, a height of 326 mm, a thickness of 1.2 mm and a weight of 0.85 kg.

The base material 1 is drawn to obtain a basic frame-shaped workpiece 2 as shown in FIG. 2, and a segment 4 is cut out from a center portion of the base material 1 by a piercing process to define a central window 3 as shown in FIG. 3. At this time, the segment 4 cut out from the base material 1 is discarded as scrap.

However, in the manufacturing method of the related art, since the base material 1 is a solid plate material, a minimum dimension thereof for enabling a drawing process to be implemented must not be decreased from that described above. Accordingly, it is considered to be difficult to save material without a change in mechanical property which requires a great deal of research and investment.

SUMMARY OF THE INVENTION

Accordingly, the present invention has been made in an effort to solve the problems occurring in the related art, and an object of the present invention is to provide a base material of a frame for a Braun tube and a method for manufacturing the frame, whereby the base material is reduced in size to save material and, additionally, power needed for driving the press machine is lowered to decrease manufacturing cost.

According to one aspect of the present invention, there is provided a base material used for manufacturing a frame for a Braun tube, the base material having a rectangular plate-shaped configuration obtained by machining a metal plate-shaped strap, the base material possessing an extended guide opening defined at a center portion thereof, the extended guide opening having a shape which is similar to the configuration of the base material and a dimension which is smaller than the base material, the base material further possessing a plurality of extended rupture-preventing grooves each defined at a corner portion of the extended guide opening to be communicated therewith, the extended rupture-preventing grooves having a diameter which is smaller than that of the extended guide opening, the strap having a pair of deformation-preventing notches formed on both side edge surfaces thereof, respectively, at a boundary region between two adjacent base materials, each notch having a bottom portion which extends parallel to the edge surface of the strap.

According to another aspect of the present invention, there is provided a method for manufacturing a frame for a Braun tube, comprising the steps of: preparing a base material by forming an extending guide opening at a center portion of a base material strap having substantially a rectangular configuration and a plurality of rupture-preventing grooves at corner portions of the extended guide opening, respectively, such that they are communicated with the extended guide opening; elongating the base material having the extended guide opening and the plurality of rupture-preventing grooves; punching the base material for defining at least one cleaning agent discharging hole therein; blanking the base material such that it has a formal size; and drawing the base material for finally shaping it as the frame.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
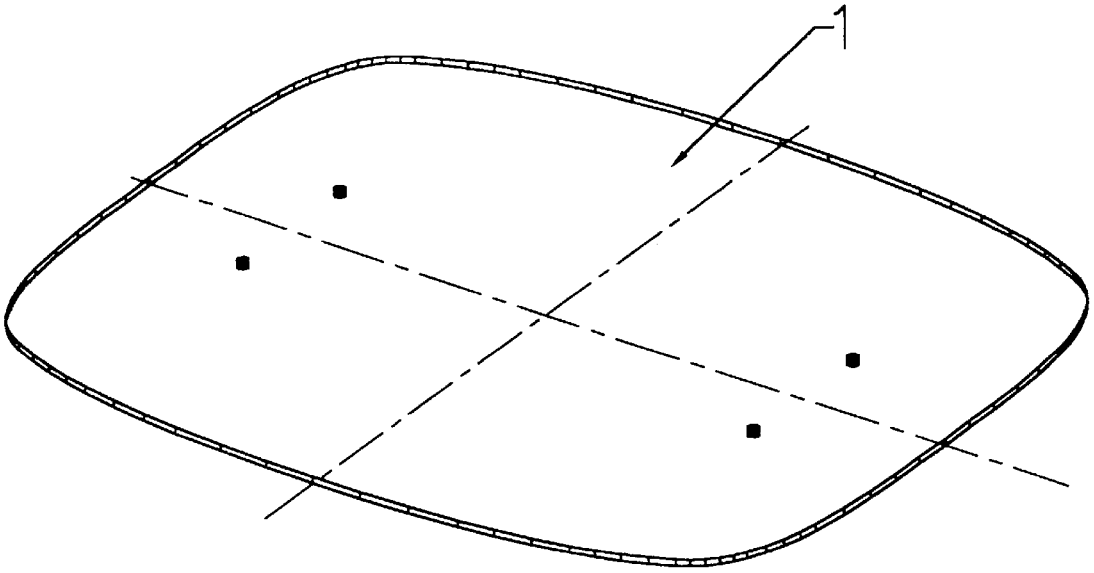
FIG. 1 is a perspective view illustrating a base material used in manufacturing a frame for a Braun tube according to the related art.
Figure 2:
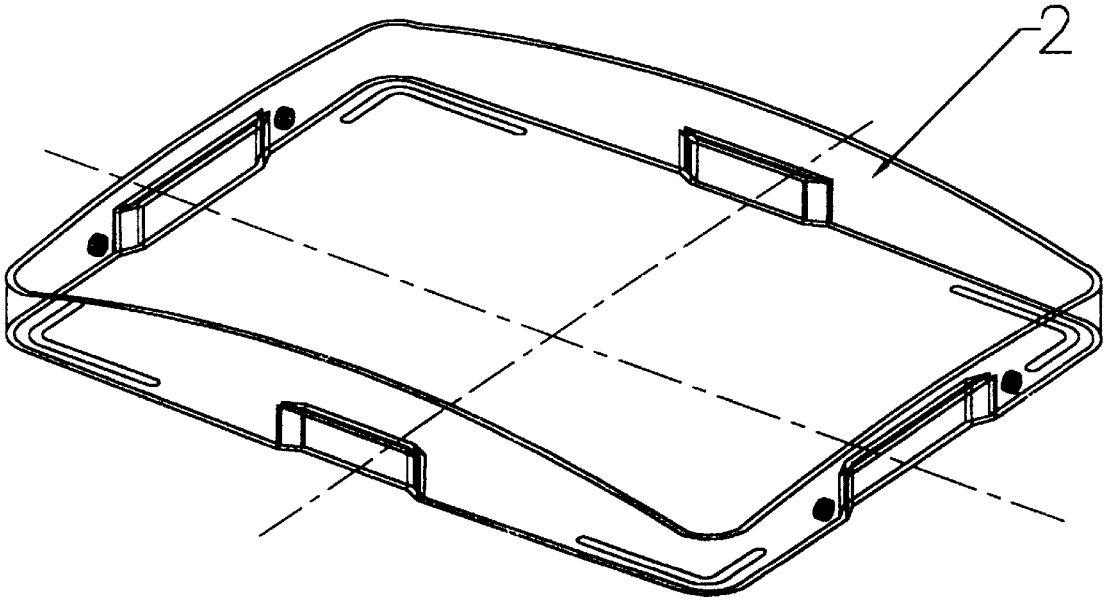
FIG. 2 is a perspective view illustrating a frame-shaped workpiece prepared by drawing the base material of FIG. 1.
Figure 3:
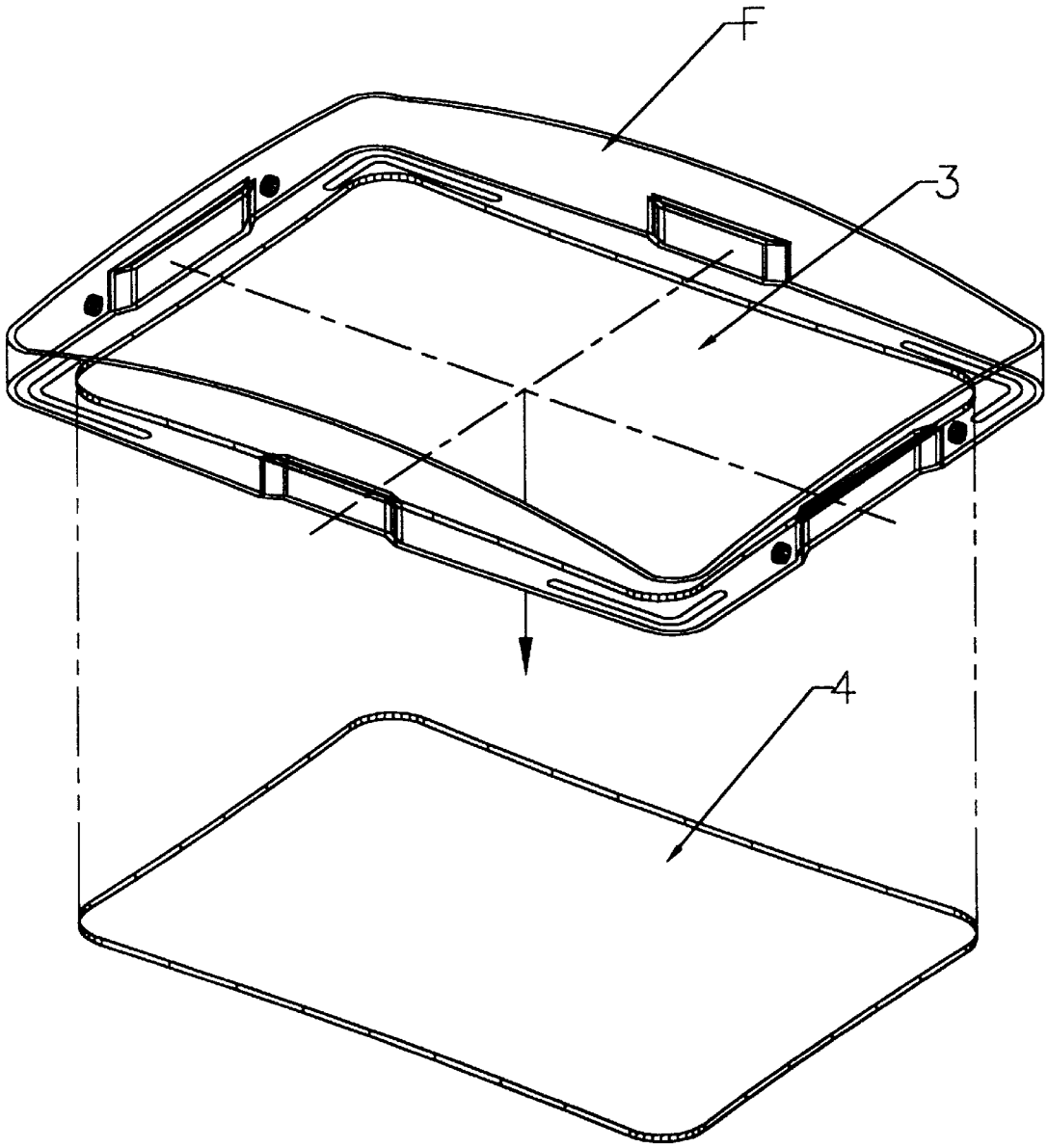
FIG. 3 is a perspective view illustrating the frame finally produced by piercing the frame-shaped workpiece of FIG. 2 for constructing a screen section.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 4:
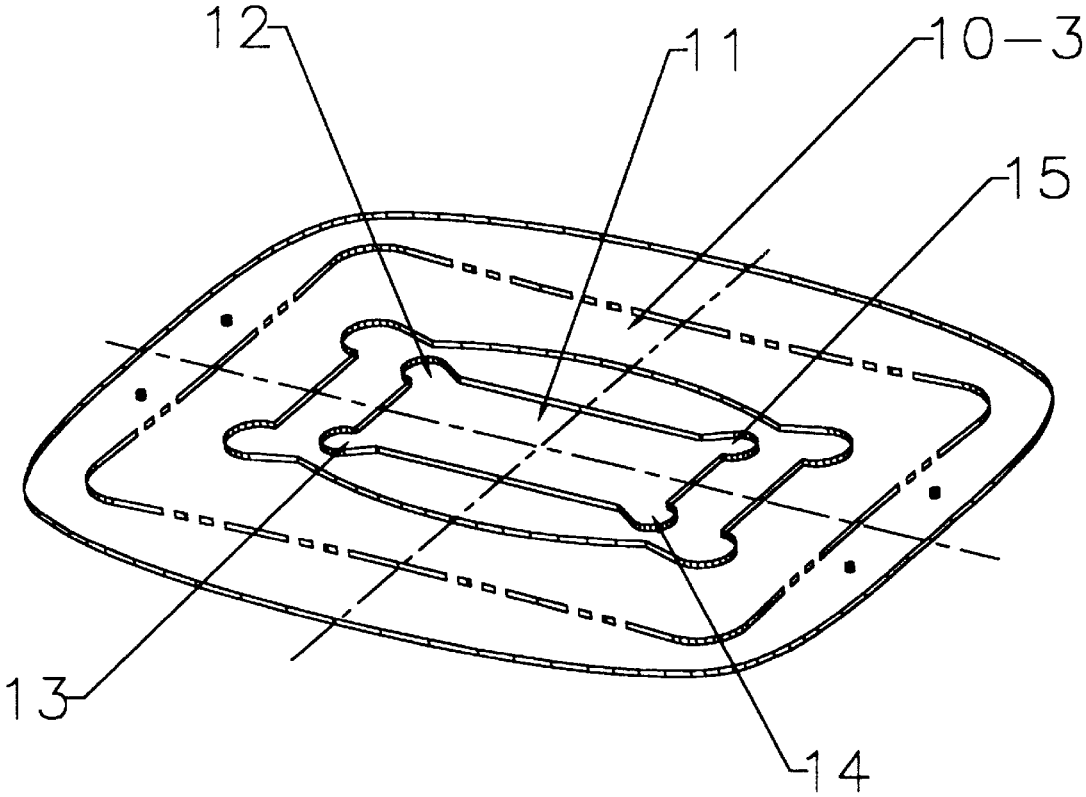
FIG. 4 is a perspective view for explaining a method for manufacturing a frame for a Braun tube in accordance with an embodiment of the present invention.
Figure 5:
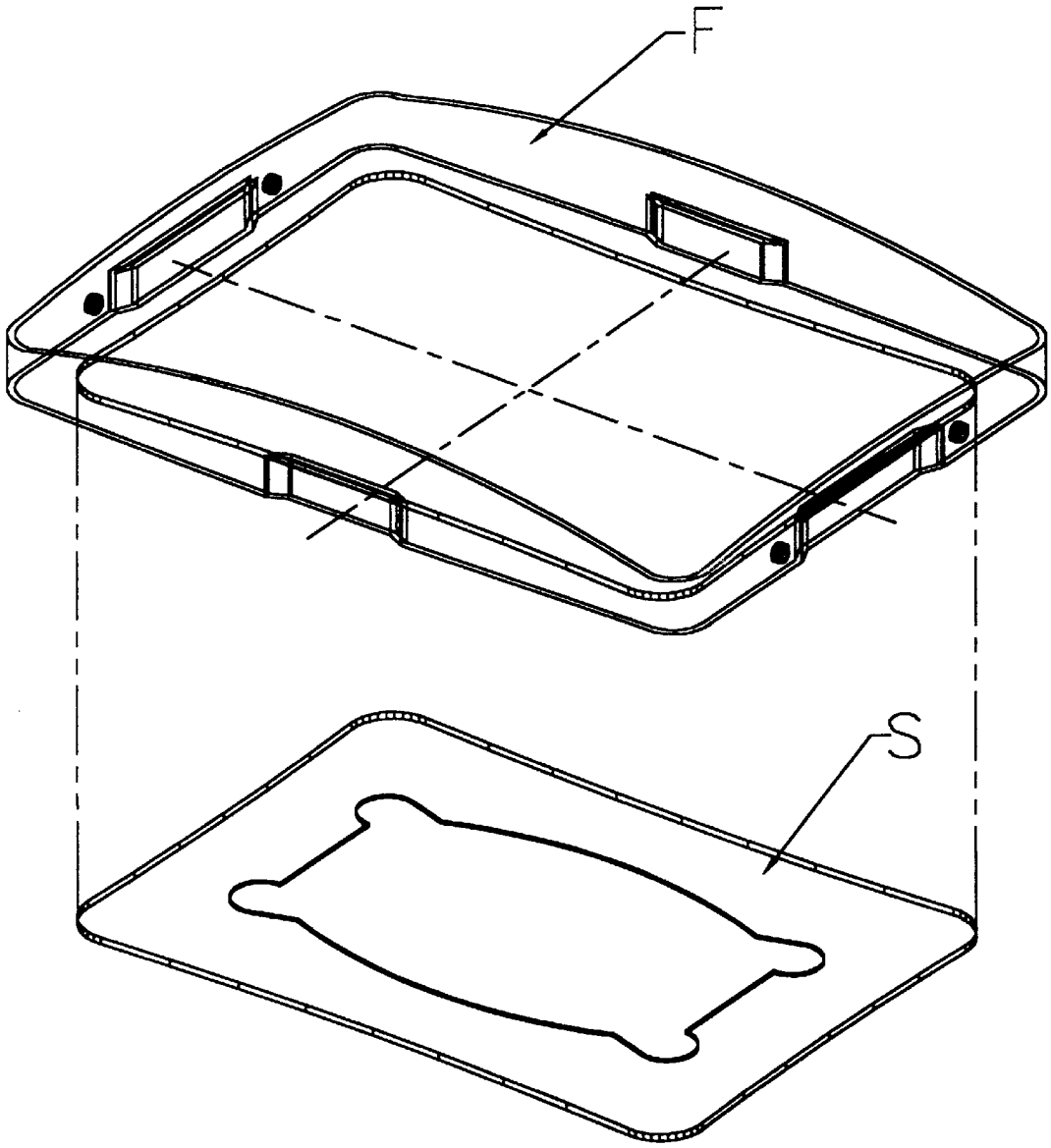
FIG. 5 is a perspective view illustrating the frame finally produced by performing a piercing step.

Referring to FIG. 4, there is shown a perspective view for explaining a method for manufacturing a frame for a Braun tube in accordance with an embodiment of the present invention; and FIG. 5 is a perspective view illustrating the frame finally produced by performing a piercing step.

According to the present invention, a base material 10 used for manufacturing a frame for a Braun tube possesses an extended guide opening 11 defined at a center portion thereof. The extended guide opening 11 has a shape which is similar to a configuration of the base material 10 and a dimension which is smaller than that of the base material 10. The base material 10 further possesses a plurality of extended rupture-preventing grooves 12, 13, 14 and 15 each defined at a corner portion of the extended guide opening 11 to be communicated therewith. Each of the extended rupture-preventing grooves 12, 13, 14 and 15 has a diameter which is smaller than that of the extended guide opening 11.

The plurality of extended rupture-preventing grooves 12, 13, 14 and 15 formed at the corner portions of the extended guide opening 11 function to prevent concentrated stresses from being generated at the corner portions while the base material 10 is under an elongating process and the elongated base material 10 from being crumpled at the corner portions, thereby to improve processability of the base material 10.

Figures 6A, 6B:
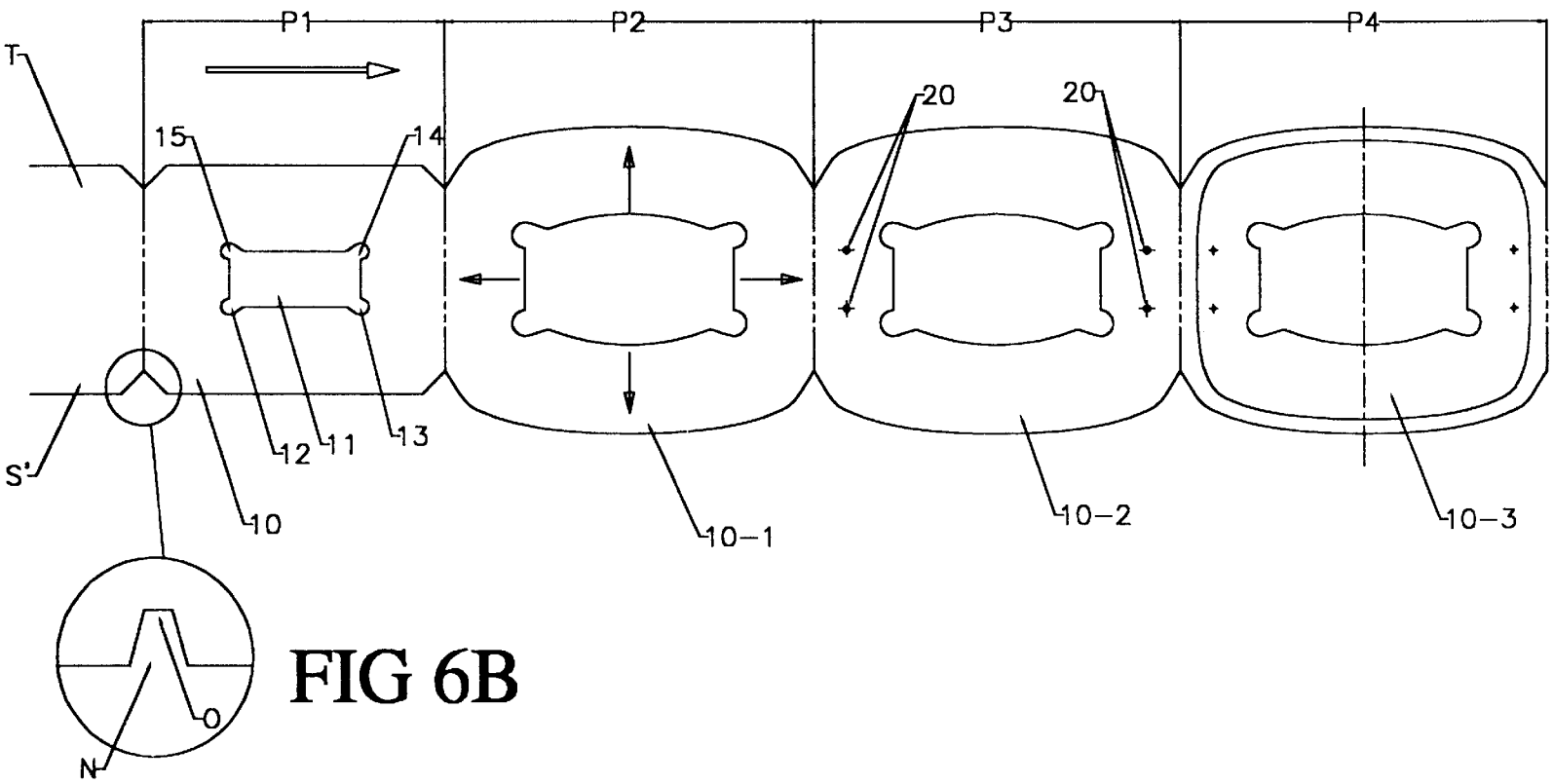
FIG. 6 is a plan view for sequentially explaining processes for manufacturing the frame according to the present invention.
Figure 7:
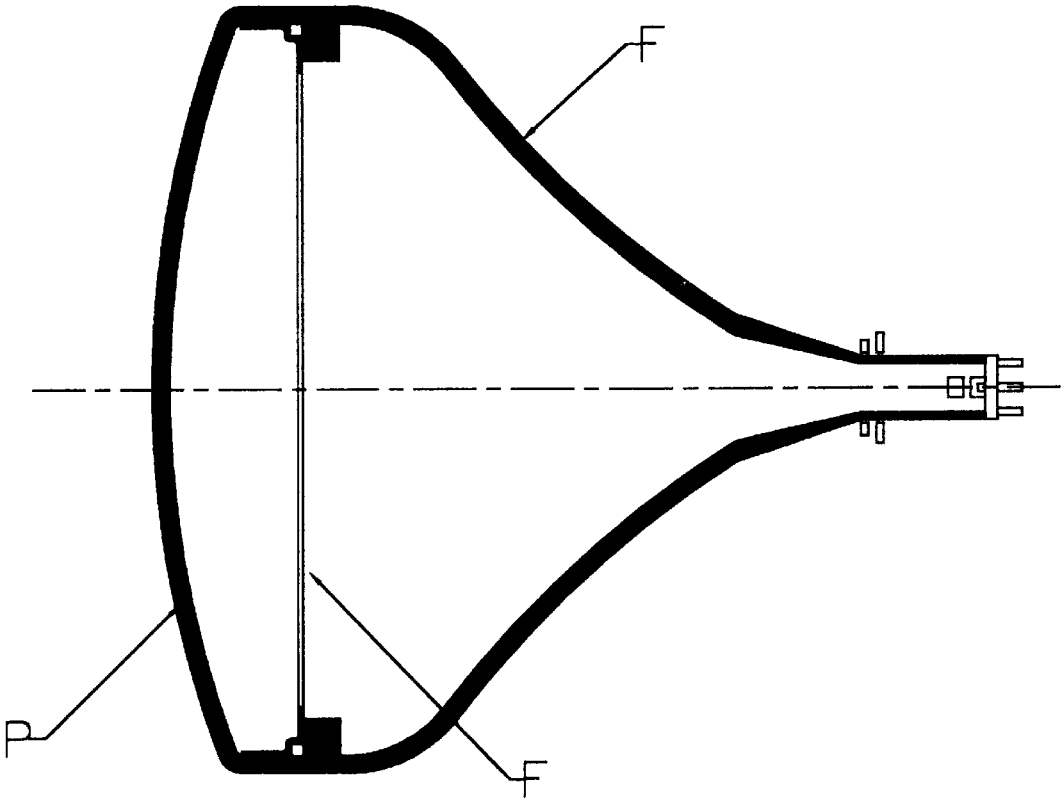
FIG. 7 is a cross-sectional view illustrating a structure in which a frame is used in a conventional Braun tube.

An original plate T is continuously fed to be used as the base material 10. At a boundary region between two adjacent base materials 10, a pair of deformation-preventing notches N are formed on both side edge surfaces of the original plate T, respectively, as shown in FIG. 6. Each deformation-preventing notch N has a bottom portion O which extends parallel to the edge surface of the original plate T. The bottom portion O serves to prevent cracks from being created at the notch N due to a stress concentration while the base materials 10 are worked or machined.

Figure 10:
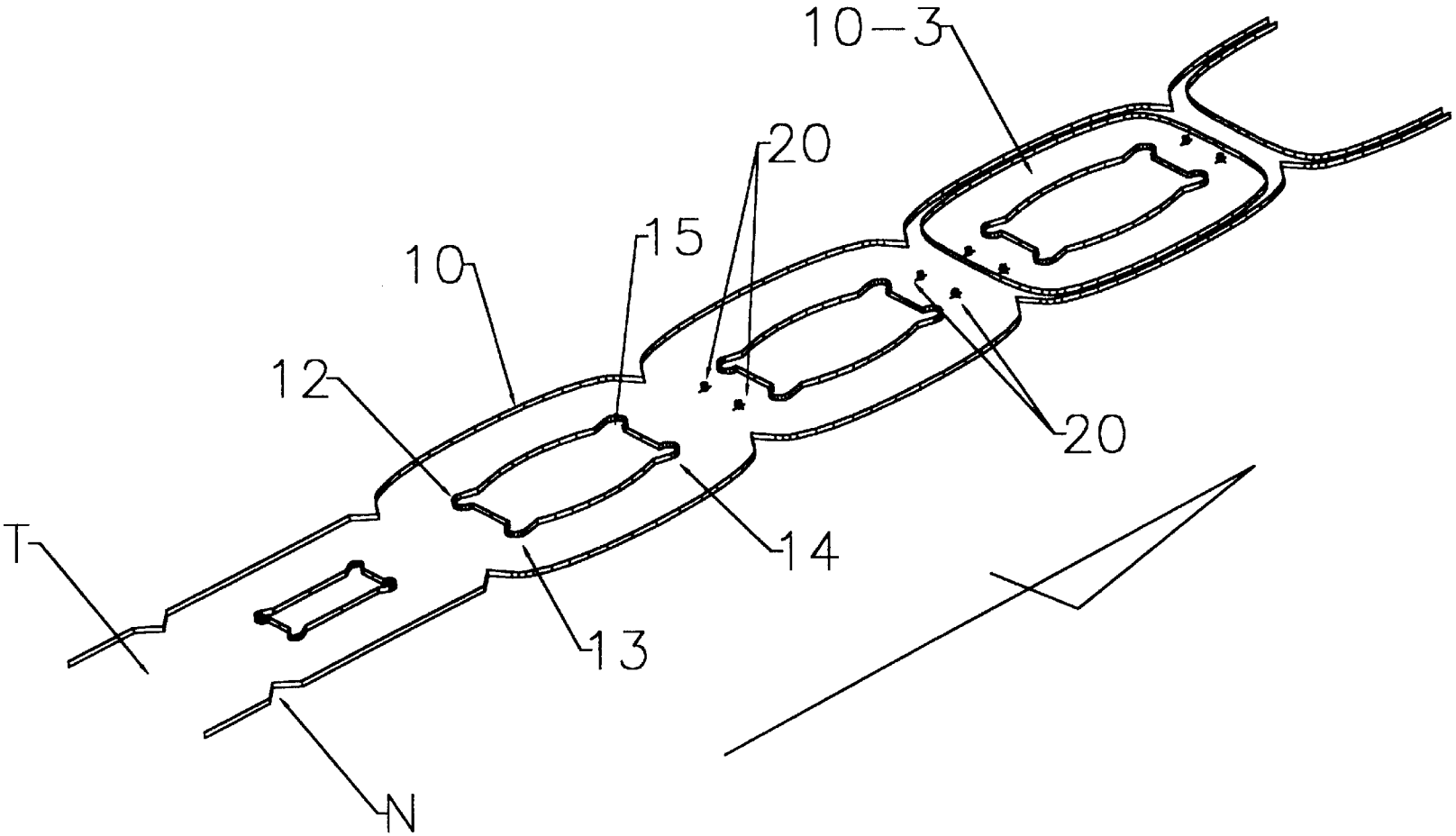
FIG. 10 is a perspective view for sequentially explaining the processes for manufacturing the frame according to the present invention.

Referring to FIG. 10, there is shown a perspective view for sequentially explaining the processes for manufacturing the frame according to the present invention. Due to the fact that the base material 10 has the extended guide opening 11 and the plurality of extended rupture-preventing grooves 12, 13, 14 and 15, the base material 10 can be elongated with the same amount of material to a greater size as compared to a base material of the related art, whereby size of the base material 10 can be remarkably reduced.

In other words, by the fact that the opening 11 and grooves 12, 13, 14 and 15 having geometrical constructions as described above are defined at the center portion of the base material 10, elongation ratio of the base material 10 can be significantly elevated. In order to further elevate the elongation ratio of the base material 10, an elongating process is implemented.

Therefore, in the present invention, the base material of a frame for a Braun tube is directed to a structure of the base material, and the method for manufacturing the frame is directed to a process and an apparatus for preparing the base material.

Figure 8A:
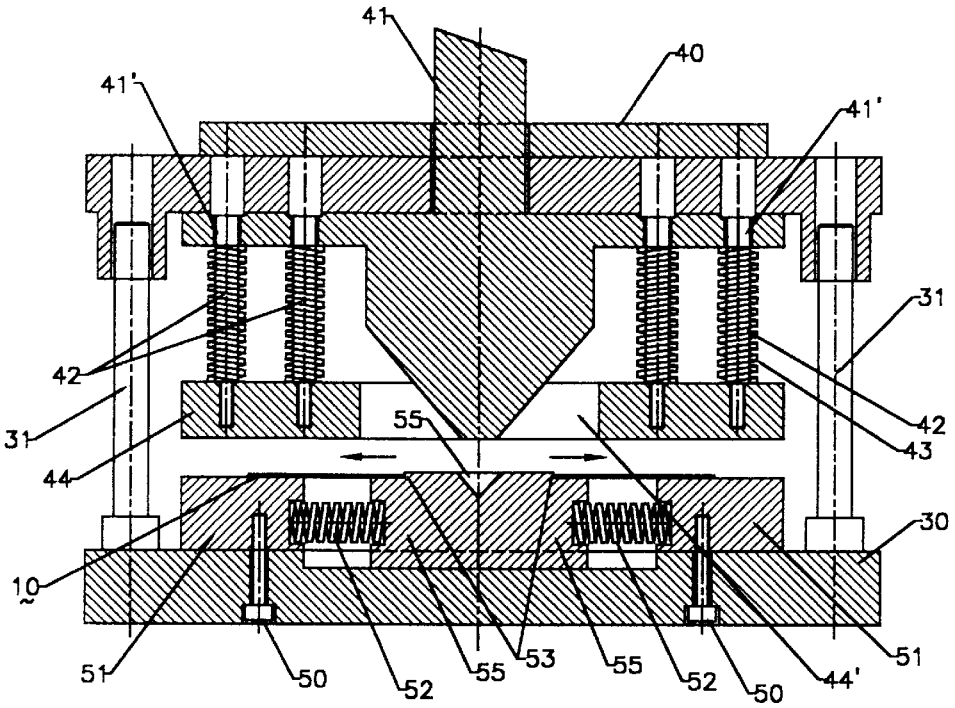
FIG. 8A is a cross-sectional view illustrating a construction of a base material elongating apparatus in which a pressing punch is in an un-operated position.
Figure 8B:
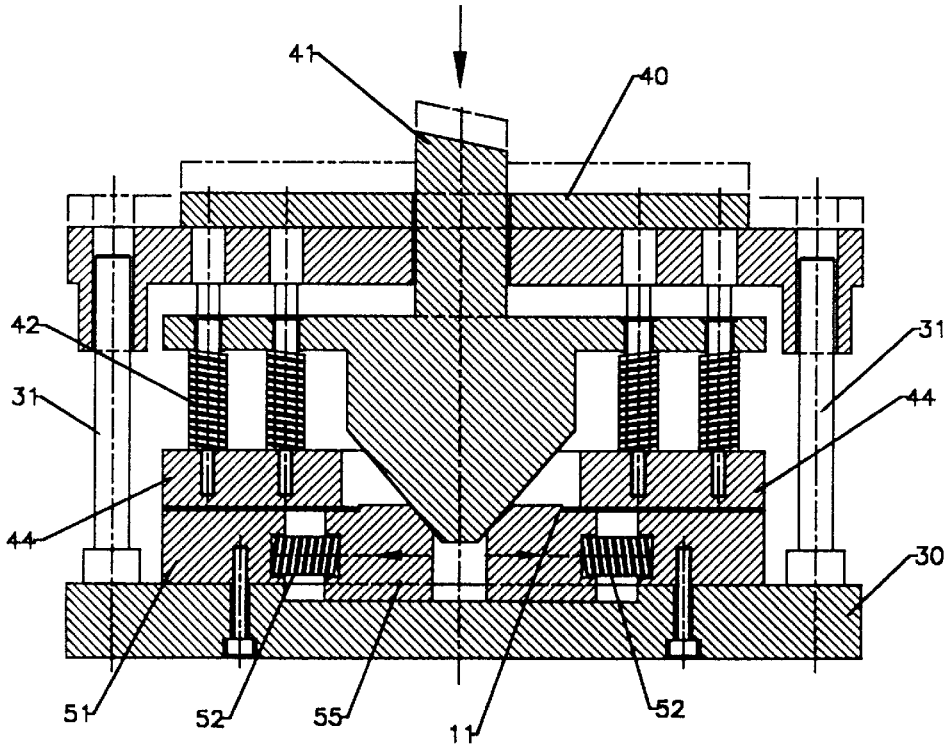
FIG. 8B is a cross-sectional view similar to FIG. 8A wherein the pressing punch is in an operated position.
Figure 9:
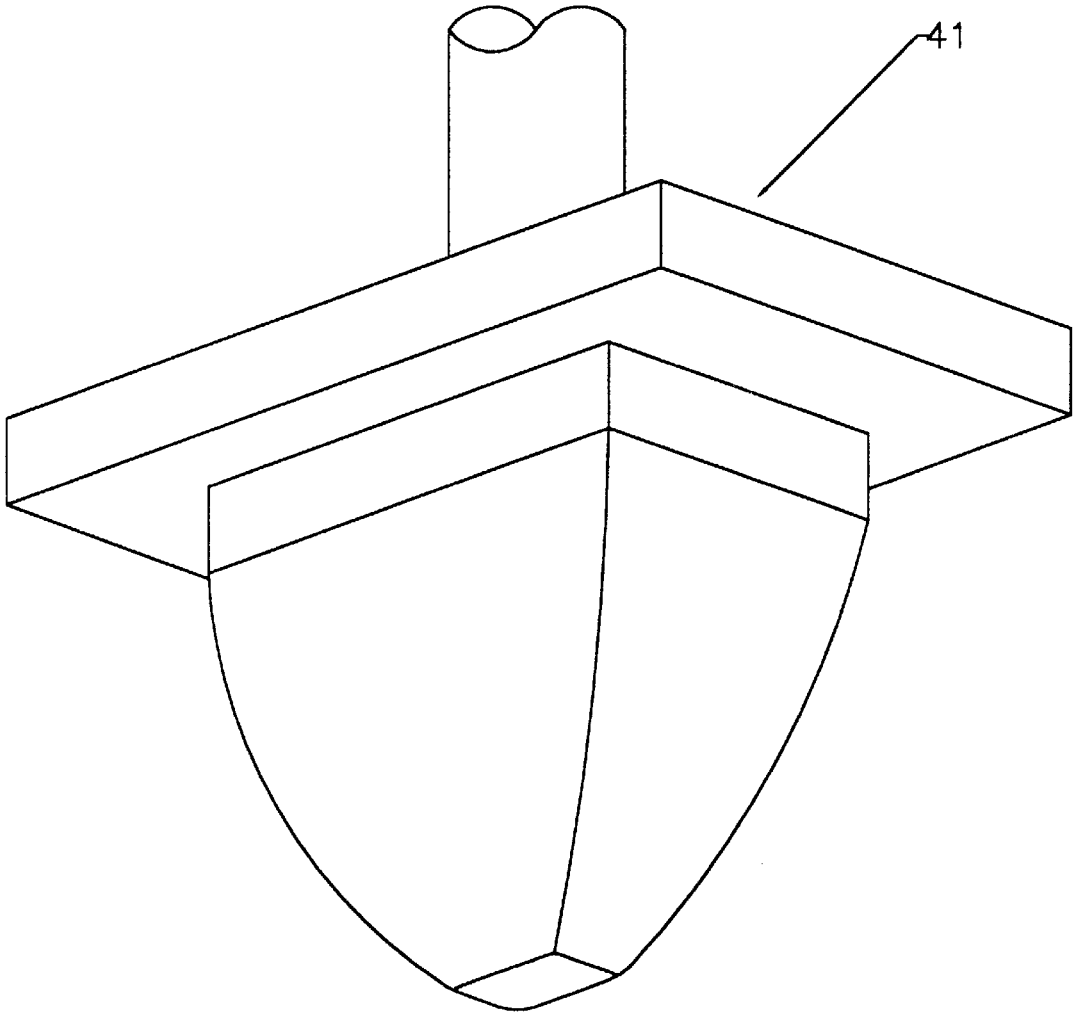
FIG. 9 is a perspective view illustrating an independent appearance of the pressing punch used in the base material elongating apparatus.

Referring to FIG. 6, there is shown a plan view for sequentially explaining processes for manufacturing the frame according to the present invention. FIG. 8A is a cross-sectional view illustrating a construction of the base material elongating apparatus in which a pressing punch is in an un-operated position, and FIG. 8B is a cross-sectional view similar to FIG. 8A wherein the pressing punch is in an operated position. FIG. 9 is a perspective view illustrating an independent appearance of the pressing punch used in the base material elongating apparatus of FIGS. 8A and 8B.

In FIG. 6, a base material strap S fed to a machine such as a general NC leveller feeder is formed with the extended guide opening 11 and the extended rupture-preventing grooves 12, 13, 14 and 15 defined at the corner portions of the extended guide opening 11, by a press punching mechanism, to prepare the base material 10 (see a first process P1).

In a second process P2 which constitutes a main part of the apparatus and method according to the present invention, the original plate T is elongated while being continuously fed, for enabling the base material 10 to have substantially the same dimension as a base material of the related art. At this time, the original plate T is elongated in a lengthwise direction thereof as shown by an arrow. A detailed construction of a base material elongating apparatus will be described later.

The base material 10-1 elongated in the lengthwise direction is then subjected to a third process P3 which is a cleaning hole punching process by which a plurality of cleaning agent discharging holes 20 are formed therein to prepare the perforated base material 10-2. Cleaning agent collected in the base material 10-2 as impurities are cleaned in a press punch mold, is discharged through the cleaning agent discharging holes 20.

A fourth process which is a blanking process is provided for cutting the base material 10-2 to have a desired size and shape before the base material 10-2 is subjected to a drawing process to be formed as the frame F.

Since the drawing process is performed in the same manner as the related art, a detailed description thereof will be omitted in the present description of the preferred embodiment. By the drawing process, scrap S is removed from the frame F.

Referring to FIGS. 8A and 8B, there is illustrated a base material elongating apparatus suitable for being used in the second process which constitutes the main part of the present invention.

The elongating apparatus includes a fixed frame 30. A plurality of vertical columns 31 performing a guide function are mounted onto an upper surface of the fixed frame 30. A pressing punch 41 is mounted to a moving frame 40 which moves up and down while its both ends are guided by the vertical columns 31.

Further, a plurality of guide bars 42 having a short length are arranged below the moving frame 40, and a squeezing plate 44 is secured to lower ends of the guide bars 42, whereby the moving frame 40 and the squeezing plate 44 are integrally lifted and lowered.

The pressing punch 41 has a plurality of slide holes 41 into which the plurality of guide bars 42 are inserted, respectively, between the squeezing plate 44 and the moving frame 40. A plurality of springs 43 are wound around the plurality of guide bars 42, respectively, to be intervened between the pressing punch 41 and the squeezing plate 44.

The squeezing plate 44 has a central opening 44 and functions to squeeze the base material 10 against a die while being biased by the plurality of springs 43 as the moving frame 40 is moved down.

On the fixed frame 30, there are disposed a pair of fixed members 51 and a pair of moving members 55. The pair of fixed members 51 have lower ends which are secured to the fixed frame 30 by bolts 50, respectively. The pair of moving members 55 are biased toward each other by a pair of springs 52, respectively, between the pair of fixed members 51. The pair of moving members 55 have at their upper ends extended projections 53 fitted into the extended guide opening 11 of the base material 10.

A notch section 55 having an inverse triangle-shaped cross-section is formed at the upper ends of the pair of moving members 55 and at a boundary region between them. The pressing punch 41 having substantially an inverse triangle-shaped cross-section can be engaged into the notch section 55. If the pressing punch 41 is engaged into the notch section 55, the pressing punch 41 separates the pair of moving members 55 from each other while overcoming biasing force of the pair of springs 52, whereby the extended guide opening 11 of the base material 10 is elongated.

As the pressing punch 41 is lowered, the squeezing plate 44 which is secured to lower ends of the plurality of guide bars 42 which in turn is connected to the moving frame 40, squeezes the base material 10 against the die. Accordingly, a plastic deformation is minimized at portions which is not the place where the machining or working is not performed.

According to the construction of the base material elongating apparatus, when the moving frame 40 is lowered and the pressing punch 41 is lowered at the same time, since the pressing punch 41 is only lowered after the squeezing plate 44 connected to the moving frame 40 squeezes the base material 10 against the die, the moving members 55 are moved to be separated from each other and according to this, the extended projections 53 fitted into the extended guide opening 11 of the base material 10 is also moved to elongate the base material 10.

By the elongating process as described above, the base material 10 having a desired size suitable for machining increases possibility of a change in geometrical and mechanical property, whereby the base material can have a remarkably reduced dimension, and material can be saved.

By experiments, results given in the following tables were obtained:

| (A) 14 inch Braun tube | Width | Height | Thickness | Weight |
|---|---|---|---|---|
| Dimension of Base Material of the Related Art | 276 mm | 327 mm | 1.2 mm | 0.85 kg |
| Dimension of Base Material of the Present Invention | 236 mm | 327 mm | 1.2 mm | 0.73 kg |
| Increase in Yield | | 14% | | |

-continued

| (B) 15 inch Braun tube | Width | | | |
|---|---|---|---|---|
| Dimension of Base Material of the Related Art | 292 mm | 345 mm | 1.2 mm | 0.95 kg |
| Dimension of Base Material of the Present Invention | 252 mm | 345 mm | 1.2 mm | 0.82 kg |
| Increase in Yield | | 14% | | |

From the above tables, it is to be readily understood that yield of the base material being an expensive metal plate is remarkably increased according to the present invention.

As a result, by a base material of a frame for a Braun tube and a method for manufacturing the frame according to the present invention, advantages are provided in that material can be significantly saved as compared to a method according to the related art, and since an extended guide opening is formed at a center portion of the base material, power loss in a press machine can be prevented, thereby to lower manufacturing cost.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A base material used for manufacturing a frame for a Braun tube, the base material having a rectangular plate-shaped configuration obtained by machining a metal plate-shaped strap, the base material possessing an extended guide opening defined at a center portion thereof, the extended guide opening having a shape which is similar to the configuration of the base material and a dimension which is smaller than the base material, the base material further possessing a plurality of extended rupture-preventing grooves each defined at a corner portion of the extended guide opening to be communicated therewith, the extended rupture-preventing grooves having a diameter which is smaller than that of the extended guide opening, the strap having a pair of deformation-preventing notches formed on both side edge surfaces thereof, respectively, at a boundary region between two adjacent base materials, each notch having a bottom portion which extends parallel to the edge surface of the strap.

2. A method for manufacturing a frame for a Braun tube, comprising the steps of:

preparing a base material by forming an extending guide opening at a center portion of a base material strap having substantially a rectangular configuration and a plurality of rupture-preventing grooves at corner portions of the extended guide opening, respectively, such that they are communicated with the extended guide opening;

elongating the base material having the extended guide opening and the plurality of rupture-preventing grooves;

punching the base material for defining at least one cleaning agent discharging hole therein;

blanking the base material such that it has a formal size; and drawing the base material for finally shaping it as the frame.

* * * * *